United States Patent [19]

Eckardt

[11] 4,125,663

[45] Nov. 14, 1978

[54] ARTICLE AND PROCESS FOR THE MANUFACTURE OF A CARRIER WEB

[75] Inventor: Peter Eckardt, Hofheim am Taunus, Fed. Rep. of Germany

[73] Assignee: Hoechst Aktiengesellschaft, Frankfurt am Main, Fed. Rep. of Germany

[21] Appl. No.: 792,862

[22] Filed: May 2, 1977

[30] Foreign Application Priority Data

May 3, 1976 [DE] Fed. Rep. of Germany ..... 2619087
May 3, 1976 [DE] Fed. Rep. of Germany ... 7613886[U]

[51] Int. Cl.[2] ..... D04H 1/58

[52] U.S. Cl. ..... 428/288; 260/852; 260/855; 260/856; 428/290; 428/480

[58] Field of Search ..... 260/29.4 UA, 29.7 NR, 260/29.7 H, 852, 855, 856; 428/288, 290, 480

[56] References Cited

U.S. PATENT DOCUMENTS

| | | | |
|---|---|---|---|
| 3,743,612 | 7/1973 | Vial | 260/29.4 UA |
| 3,922,419 | 11/1975 | Hammer et al. | 260/29.4 UA |
| 3,940,537 | 2/1976 | Barns | 428/288 |
| 3,967,032 | 6/1976 | Plotz et al. | 428/300 |
| 3,996,481 | 12/1976 | Hayashi | 260/29.7 NR |

*Primary Examiner*—James J. Bell
*Attorney, Agent, or Firm*—Curtis, Morris & Safford

[57] ABSTRACT

A process is described for the production of a carrier web of a spun bond consisting of synthetic polyester filaments having a melting point of more than 230° C and a filament titer of approximately 3 to 15 dtex. To this spun bond, a chemical binder is applied in the form of an aqueous dispersion which is dried at approximately 120° to 220° C. The dispersion consists of (a) 10 to 60% by weight of a copolymer of
60 to 90% by weight of styrene,
5 to 20% by weight of butadiene,
2 to 10% by weight of acrylic acid and
2 to 10% by weight of acrylamide,
(b) 5 to 30% by weight, calculated on the amount of copolymer, of a melamine formaldehyde precondensate,
(c) a catalytic amount of acid catalysts, as well as, optionally,
(d) further inert additives.

Such a carrier web is characterized by a weight per unit area of approximately 80 to 400 g/m$^2$
a strength, longitudinally, of approximately 30 to 140 daN/5 cm,
an elongation at break, longitudinally, of approximately 20 to 50%,
a break propagation resistance of approximately 2 to 9 daN,
a specific resistance of at least 38 (daN/5 cm) : (100 g/m$^2$) and
a specific elongation, longitudinally, at 180° C and 5 daN/5 cm load, of 600% · g/m$^2$ maximum.

6 Claims, 1 Drawing Figure

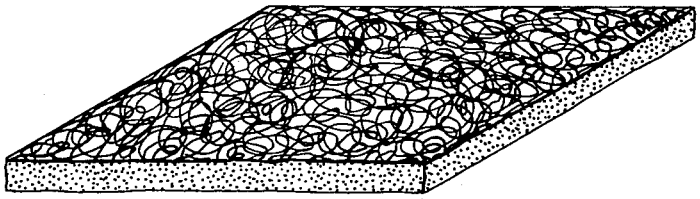

ARTICLE AND PROCESS FOR THE MANUFACTURE OF A CARRIER WEB

It is known that the reinforcing fabrics used in sheets of roofing materials and the like are responsible for their dimensional stability and strength properties. The known reinforcing fabrics or carrier webs of this type are, for example, raw felt cardboards, woven fabrics and fleeces made of glass and synthetic materials etc. In particular, spun bonds made of synthetic polyester filaments which have been chemically strengthened in a special manner, have proved suitable as carrier webs (Belgian patent specification No. 819,696 which corresponds to U.S. Pat. No. 3,967,032). The polyester filaments are those having a melting point of more than 250° C. and a titer of a single filament of approximately 3 to 15 dtex; preferably polyethylene terephthalate filaments are used. The chemical bonding of the filaments in the spun bond is effected with approximately 10 to 30% by weight, calculated on the unimpregnated fleece, of an aqueous, neutral to weakly-alkaline binder dispersion having a solids content of 10 to 60% by weight, containing a copolymer of

| | |
|---|---|
| 45 to 55 % by weight | of an acrylic acid ester or methacrylic acid ester of monohydric alcohols having 1 to 8 carbon atoms, |
| 24 to 30 % by weight | of acrylonitrile, |
| 12.5 to 30 % by weight | of styrene, |
| 0.5 to 2.5 % by weight | of acrylic acid amide, prepared by emulsion polymerisation in the presence of anionic and/or non-ionic emulsifiers as well as activators according to German Auslegeschrift No. 1 619 056, and |
| 10 to 30 % by weight | calculated on the solids content of this binder dispersion, of a melamine formaldehyde precondensate. |

The fleece is impregnated and bonded with this binder dispersion at the points of contact between the threads to form bonds at the points of contact between the threads or filaments of the fleece. The strengthened fleece then has the following properties:

- a weight per unit area of approximately 80 to 300 g/m$^2$,
- a strength of approximately 20 to 100 Kp/5 cm,
- an elongation at break of approximately 25 to 50% and
- a break propagation resistance of approximately 4 to 9 Kp.

To produce a bituminized roofing web this fleece is bituminized and sanded by known methods.

A problem which keeps recurring in the production of bituminized roofing webs during bituminization of the carrier webs, which is carried out under tension at temperatures of the order of approximately 140° to 200° C., is the shrinkage in width of the carrier webs. At the rather high temperatures employed, both the synthetic filaments of the fleece and the binders used soften so that as a result of the longitudinal tension on the web there is an increase in length and consequent decrease in width. The shrinkage in width during bituminization should be no more than approximately 1 to 2% at the most, since otherwise undesirable wrinkles form, to some extent during the production of the roofing webs, and to some extent later, in particular when the finished roofing webs are exposed for a long period to sun rays or the like; this occurs because the synthetic fleece materials have the tendency, under the action of elevated temperatures, to reverse the shrinkage in width.

Although the carrier web known from Belgian Patent Specification No. 819,696 exhibits relatively small shrinkages in width during bituminization, owing to the ever increasing demands on product quality it became desirable, and this became the problem posed, to produce a carrier web which during bituminization or, during coating generally, exhibits an even smaller shrinkage in width.

It has been found possible to solve this problem in accordance with the invention by strengthening a polyester spun bond by means of a special chemical binder which is different from that described in Belgian patent specification No. 819,696. The subject of the invention is therefore a process for the manufacture of a carrier web made of a spun bond of synthetic polyester filaments having a melting point of more than 230° C. — preferably of polyethylene terephthalate filaments — and a titer of a single filament of approximately 3 to 15 dtex, bonded with approximately 10 to 30% by weight, calculated on the unbonded spun bond, of a chemical binder, by applying the binder to the spun bond in the form of an aqueous dispersion and strengthening it by drying at approximately 120° to 220° C., which process is characterised in that there is used as aqueous dispersion a dispersion which contains (a) 10 to 60% by weight of a copolymer of
60 to 90% by weight of styrene,
5 to 20% by weight of butadiene,
2 to 10% by weight of acrylic acid and
2 to 10% by weight of acrylamide,
(b) 5 to 30% by weight, calculated on the amount of copolymer, of a melamine formaldehyde precondensate.
(c) acid catalysts, such as p-toluenesulfonic acid, triethylamine hydrochloride or maleic acid, as well as, optionally,
(d) further inert additives, such as thickeners, antifoam agents, dyestuffs, etc.

The carrier web obtained according to this process thus has the following properties:

- a weight per unit area of approximately 80 to 400 g per m$^2$,
- a strength of approximately 30 to 140 daN/5 cm,
- an elongation at break of approximately 20 to 50%,
- a break propagation resistance of approximately 2 to 9 Kp,
- a specific strength of at least $$38\ (\text{daN}/5\ \text{cm}) : (100\ \text{g/m}^2)$$

and a specific elongation, longitudinally, at 180° C. and 5 daN/5 cm load, of 600%. g/m$^2$ maximum.

To carry out the process according to the invention, the starting material used is a spun bond of polyester filaments having a melting point of more than 230° C. and a filament titer of approximately 3 to 15 dtex; the polyester preferred is polyethylene terephthalate. The spun bond is advantageously prestrengthened by calandering and/or by needling. The fleece is then impregnated with the special aqueous binder dispersion, printed or the like. The amount of the dispersion applied shall be such that after drying approximately 10 to 30% by weight of solid binder, calculated on the unbounded fleece, remains on the fleece. If desired, it is possible to determine by preliminary test how much aqueous dispersion must be applied to the fleece in order that the desired quantity of solid binder remains after drying at approximately 120° to 220° C. During the drying hardening of the binder occurs.

The binder agent dispersion is composed of a particular copolymer, a melamine formaldehyde precondensate, acid catalysts, possibly further inert additives such as thickeners, antifoam agents, dyestuffs, and water. The copolymer consists of:

60 to 90% by weight of styrene units,
5 to 20% by weight of butadiene units,
2 to 10% by weight of acrylic acid units and
2 to 10% by weight of acrylamide units.

It is advantageously prepared by emulsion polymerisation in the presence of anionic and/or non-ionic emulsifiers as well as activators, analogously to the instruction given in German Auslegeschrift No. 1,619,056 for the copolymer described therein.

The melamine formaldehyde precondensate is a product obtainable on the market, for example, in the form of an aqueous solution. There is nothing in particular to be said regarding the acid catalysts and the possible further additives (thickeners, antifoam agents, dyestuffs etc.). The dried spun bond, chemically bonded as described, should have a weight per unit area of approximately 80 to 400 g/m$^2$. If an unbonded fleece is used as starting material, the weight per unit area of which is reduced by the amount of the weight of binder to be applied, then the desired weight per unit area as well as, also, the other special properties of the carrier web, are achieved exactly. Further explanations regarding the strength of approximately 30 to 140 daN/5 cm and the elongation at break of approximately 20 to 50% of this carrier web should not be necessary. The tear propagation resistance of approximately 2 to 9 Kp is determined according to the DIN standard 53 859.

The specific strength and the specific elongation are values which are independent of the weight per unit area of the spun bond and have been introduced in order better to illustrate the advance of the subject of the invention in comparison with the State of the Art. There are carrier webs known in the art that are practically no different from the carrier web obtainable according to the invention as regards weight per unit area, strength, elongation at break and tear propagation resistance (Belgian patent specification No. 819 696), but the specific strength and specific elongation of these carrier webs are clearly inferior to the values of the carrier web obtainable according to the invention.

The specific strength is calculated by the relation of the measured strength to the weight per unit area of 100 g/m$^2$ according to the following equation:

$$\text{specific strength} = \frac{\text{strength} \times 100}{\text{weight per unit area of spun bond}} \left[ \frac{daN}{5\ \text{cm}} \div \frac{100\ \text{g}}{\text{m}^2} \right]$$

The specific elongation is calculated as follows: as measuring value for the elongation, the elongation at a load of 5 daN/5 cm was selected from a stress-strain graph measured at 180° C. The product of elongation at 180° C. at a load of 5 daN/5 cm and the weight per unit area is then the specific elongation according to the following equation:

$$\text{specific elongation} = \text{elongation (\%)} \times \text{weight per unit area (g/m}^2\text{)}.$$

In the specific strength and the specific reference elongation, the influence of the weight per unit area is eliminated, so that only the properties of the binder are expressed. The corresponding values of the carrier webs according to the closest prior art (Belgian patent specification No. 819,696) lie in some cases considerably below (specific strength) and above (specific elongation), respectively, the values of the carrier web obtained according to the invention. This shows that the chemical binder on this carrier web has a considerably better binding action for polyester spun bonds than the known binders. As a result of this better binding action, the shrinkage in width of the carrier web obtained according to the invention, for example during bituminization, is considerably smaller than the shrinkage in width of the carrier web known, for example, for Belgian patent specification No. 819,696. This may be seen from the following result of the test for dimensional stability under heat of a carrier web obtained according to the present invention and of a carrier web according to Belgian patent specification No. 819,696.

Polyethylene terephthalate spun bond (filament titer 4 dtex), prestrengthened by needling and calandering and having a weight per unit area of 110 g/m$^2$, was strengthened in one case with a binder of the said Belgian Patent Specification and in another case with a binder of the afore-described type. In both cases the binder application was approximately 15% by weight, so that a weight per unit area of 130 g/m$^2$ resulted. Samples of a length of 20 cm and a width of 10 cm were exposed in a hot air atmosphere of 180° C. to a load of 3 Kp for a period of 4 minutes. After releasing the tension, the sample treated in accordance with the invention exhibited a lengthening of 2.0% and a shrinkage in width of 1.0%. The control sample according to Belgian patent specification No. 819,696 exhibited a lengthening of 3.5% and a shrinkage in width of, likewise, 3.5%. It was extremely surprising and unexpected that it was possible to achieve by a variation of the binder described in Belgian patent specification No. 819,696, in the manner according to the invention, a further increase in the dimensional stability and the strength properties of corresponding polyester spun bonds, especially at elevated temperatures, since a considerable number of all other possible binder variations exhibited exactly the opposite effect.

Owing to its excellent dimensional stability and strength properties, the carrier web obtained according to the invention is especially suitable as a reinforcing material for bituminized roofing webs and the like. The bituminized carrier webs may also be cut into weather tiling for roof covering and for facing exterior house walls. For the latter purpose there are used in particular bituminized webs that are optionally color-sanded. Furthermore, the carrier webs according to the invention can naturally also be coated with polyvinyl chloride or polyethylene etc. A panel of bituminized carrier web prepared in accordance with the invention is illustrated in the FIGURE.

The following examples are intended to serve for the further illustration of the subject of the invention.

EXAMPLE 1

A calandered spun bond of polyethylene terephthalate filaments of an individual titer of 4 dtex, having a weight per unit area of 115 g/m$^2$, is completely impregnated with an aqueous binder dispersion of the following composition:

480 g/l of an aqueous dispersion, containing 50% by weight of a copolymer of
80% by weight of styrene,
11% by weight of butadiene,
5% by weight of acrylic acid and
4% by weight of acrylamide,
50 g/l of a 75% by weight solution of trimethylolmelamine trimethyl ether,
2 g/l of a 30% by weight solution of triethylamine hydrochloride,
60 g/l of a 10% by weight solution of the ammonium salt of a polyacrylic acid,
480 g/l of water.

After drying and condensation of the binder at approximately 180° C., the spun bond has a weight of 132.5 g/m$^2$, corresponding to a binder application of 15% by weight.

The bonded spun bond is characterized by the following technological data:

| | |
|---|---|
| strength, longitudinal | 53 daN/5 cm |
| elongation at break, longitudinal | 30 % |
| propagation resistance elongation at 180° C (load 5 daN/5 cm) | 3.5 daN<br>4.3 % |
| specific strength, longitudinal | $40 \frac{\text{daN}}{5\text{ cm}} : \frac{100\text{ g}}{\text{m}^2}$ |
| specific reference elongation at 180° C. (5 daN/5 cm load), longitudinal: | 570 %. g/m$^2$. |

A roofing web produced from this carrier web by bituminization and sanding is characterized by the following technological data:

| | |
|---|---|
| maximum strength, longitudinal | 65 daN/5 cm |
| maximum elongation at break, longitudinal | 35 % |
| break propagation resistance, longitudinal and transverse | 1.8 daN |
| nail tear-out resistance, longitudinal | 9.3 daN |
| nail tear-out resistance, transverse | 9.9 daN |
| bending strength, longitudinal and transverse | 5000 turns. |

The nail tear-out resistance values are ascertained as follows: in a specimen 15 cm long and 5 cm wide, a nail 6 cm long is in each case driven through 5 cm from the upper edge and 5 cm from the lower edge in such a manner that the nails project half way out on each side of the specimen. On both sides, a metal band having eyelets is fitted over each nail, and the ends of the metal bands are introduced into and screwed tight into the clamps of a tensioning device. The specimen is now positioned with little tension between the clamps of the test apparand without itself touching the clamps. The two parts of the test apparatus are then moved apart at a speed of 5 cm/minute and in so doing the nails are pulled through the specimen, which does not, itself, move. The force required to move the nails is the nail tearout resistance.

Determination of the bending strength:

The handing is effected with the aid of the repeated bending test apparatus of the firm Schopper. A test strip 30 mm wide under a prestress of 1 Kp is, in this apparatus, moved to and fro at 120 cycles/minute continuously at twice 90° at the clamping point until the hydrophobic carrier material breaks.

Comparison Example

The same spun bond as in the above Example 1 was provided with 15% by weight of the binder described in Example 1 of the Belgian Patent Specification No. 819696. The binder consisted of a dispersion comprising:

300 g/l of an aqueous, neutral-adjusted binder dispersion having a solids content of 50% by weight, containing a copolymer of 52% butyl acrylate, 25% acrylonitrile, 21% styrene and 2% acrylic acid amide,
30 g/l of an 80% solution of trimethylolmelamine trimethyl ether and
670 g/l of water.

The fleece has the following properties:

| | |
|---|---|
| weight per unit area: | 132.5 g/m$^2$ |
| strength resistance, longitudinal: | 39.2 daN/5 cm |
| elongation at break, longitudinal: | 25.9 % |
| tear propagation resistance: elongation at 180° C (load 5 daN/5 cm) longitudinal: | 3.5 daN<br>10.5 % |
| specific strength, longitudinal: | $34.0 \frac{\text{daN}}{5\text{ cm}} : \frac{100\text{ g}}{\text{m}^2}$ |
| specific elongation at 180° C, longitudinal: | 1208 % · g/m$^2$ |

EXAMPLE 2

The binder mentioned in Example 1 is applied by printing on a calandered spun bond of polyethylene terephthalate filaments of an individual titer of 4 dtex having a weight per unit area of 182 g/m$^2$ in such a manner that a punctiform pattern is produced (distance between points: 4 mm; point diameter: 2 mm).

After drying and condensation of the binder at approximately 180° C., the spun bond has a weight per unit area of 210 g/m$^2$, corresponding to a binder application of 15.3% by weight. The technological data of the carrier web are:

| | |
|---|---|
| strength, longitudinal: | 82 daN/5 cm |
| elongation at break, longitudinal: | 30 % |
| tear propagation resistance: elongation at 180°0 C (load 5 daN/5 cm): | 5.6 daN<br>2.5 % |
| specific (tear) strength longitudinal: | $39.0 \frac{\text{daN}}{5\text{ cm}} : \frac{100\text{ g}}{\text{m}^2}$ |
| specific elongation at 180° C, longitudinal: | 567 % · g/m$^2$ |

EXAMPLE 3

A calandered spun bond of polyethylene terephthalate filaments of an individual titer of 4 dtex having a weight per unit area of 250 g/m$^2$ is impregnated with a binder of the following composition by imprinting a check pattern (distance between lines 5 mm, thickness of lines 2 mm):

263 g/l of an aqueous dispersion, containing 50% by weight of a copolymer of
80% by weight of styrene,
11% by weight of butadiene,
5% by weight of acrylic acid,
4% by weight of acrylamide,
15.7 g/l of a 75% solution of a trimethylolmelamine trimethyl ether, 0.5 g/l of a 30% solution of aqueous p-toluenesulfonic acid,
10.5 g/l of a 10% by weight solution of the ammonium salt of a polyacrylic acid,
710.3 g/l of water.

After drying and condensation of the binder, the spun bond has a weight of 283 g/m$^2$, corresponding to a binder application of 13.2%.

The bonded spun bond is characterized by the following technological data:

| | |
|---|---|
| strength, longitudinal: | 109.8 daN/5 cm |
| elongation at break, longitudinal: | 31 % |
| tear propagation resistance: | 6.3 daN |
| elongation at 180° C (load 5 daN/5 cm): | 1.9 % |
| specific strength, longitudinal: | $38.8 \frac{daN}{5\ cm} : \frac{100\ g}{m^2}$ |
| specific elongation, longitudinal (5 daN/5 cm load): | 588 % · g/m$^2$. |

I claim:

1. In a process for the production of a carrier web of a spun bond consisting of synthetic polyester filaments having a melting point of more than 230° C. and a filament titer of approximately 3 to 15 dtex, bonded by approximately 10 to 30% by weight, calculated on the unbonded spun bond, of a chemical binder, by applying the same to the spun bond in the form of an aqueous dispersion and hardening by drying at approximately 120 to 220° C., the improvement which comprises using an aqueous dispersion comprising
(a) 10 to 60% by weight consisting of a copolymer of 60 to 90% by weight of styrene,
5 to 20% by weight of butadiene,
2 to 10% by weight of acrylic acid and
2 to 10% by weight of acrylamide,
(b) 5 to 30% by weight, calculated on the amount of copolymer, of a melamine formaldehyde precondensate, and
(c) a catalytic amount of acid catalyst.

2. The process according to claim 1, wherein the polyester filaments used are composed of polyethylene terephthalate.

3. A carrier web of a chemically bonded spun bond of synthetic polyester filaments having a melting point of more than 230° C. and an individual filament titer of approximately 3 to 15 dtex, characterized by
a weight per unit area of approximately 80 to 400 g/m$^2$
a strength, longitudinally, of approximately 30 to 140 daN/5 cm,
an elongation at break, longitudinally, of approximately 20 to 50%,
a break propagation resistance of approximately 2 to 9 daN,
a specific strength of at least $$38\ (daN/5\ cm) \div (100\ g/m^2)$$

and
a specific elongation, longitudinally, at 180° C. and 5 daN/5 cm load, of 600%. g/m$^2$ maximum.

4. A carrier web according to claim 3, wherein the chemically bonded spun bond is bonded with approximately 10 to 30% by weight, calculated on the unbonded spun bond, of a polymeric binder deposited from an aqueous dispersion containing
(a) 10 to 60% by weight consisting of a copolymer of 60 to 90% by weight of styrene,
5 to 20% by weight of butadiene,
2 to 10% by weight of acrylic acid and
2 to 10% by weight of acrylamide,
(b) 5 to 30% by weight, calculated on the amount of copolymer, of a melamine formaldehyde precondensate, and
(c) a catalytic amount of acid catalyst.

5. A process according to claim 1 wherein the aqueous dispersion comprises, in addition to components (a), (b) and (c), inert additives.

6. A carrier web according to claim 4 wherein the polymeric binder is deposited from an aqueous dispersion containing, in addition to components (a), (b) and (c), inert additives.

* * * * *